US007063606B2

(12) United States Patent
Stierle et al.

(10) Patent No.: US 7,063,606 B2
(45) Date of Patent: Jun. 20, 2006

(54) PORTABLE POWER TOOL WITH PROTECTIVE COVER

(75) Inventors: Peter Stierle, Waldenbuch (DE); Juergen Wiker, Leinfelden-Echterdingen (DE); Maria-Margareta Sulea, Leinfelden-Echterdingen (DE); Stefan Heess, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/522,975

(22) PCT Filed: Jul. 22, 2004

(86) PCT No.: PCT/DE2004/001615

§ 371 (c)(1),
(2), (4) Date: Feb. 1, 2005

(87) PCT Pub. No.: WO2005/035190

PCT Pub. Date: Apr. 21, 2005

(65) Prior Publication Data

US 2005/0215186 A1 Sep. 29, 2005

(30) Foreign Application Priority Data

Sep. 16, 2003 (DE) ..... 103 43 060

(51) Int. Cl.
*B24B 23/00* (2006.01)

(52) U.S. Cl. ..... 451/359; 451/451; 451/454

(58) Field of Classification Search ..... 451/344, 451/359, 357, 451, 456, 457, 454
See application file for complete search history.

(56) References Cited

U.S. PATENT DOCUMENTS

| | | | | |
|---|---|---|---|---|
| 4,060,940 | A | 12/1977 | DeWitt | |
| 4,574,532 | A * | 3/1986 | Haberle et al. | 451/451 |
| 5,005,321 | A * | 4/1991 | Barth et al. | 451/359 |
| 5,440,815 | A * | 8/1995 | Inkster | 30/390 |
| 5,766,062 | A | 6/1998 | Edling | |
| 6,464,573 | B1 * | 10/2002 | Keller | 451/451 |
| 6,669,544 | B1 * | 12/2003 | Walz et al. | 451/454 |
| 6,699,114 | B1 * | 3/2004 | Booeshaghi et al. | 451/451 |

FOREIGN PATENT DOCUMENTS

| | | | |
|---|---|---|---|
| DE | 3638337 | * | 5/1988 |
| DE | 3940584 | * | 6/1991 |
| DE | 19829190 | * | 1/2000 |
| DE | 199 14 855 A1 | | 10/2000 |

* cited by examiner

*Primary Examiner*—Eileen P. Morgan
(74) *Attorney, Agent, or Firm*—Michael J. Striker

(57) ABSTRACT

A portable power tool, in particular an angle grinder (10), includes a longitudinal housing (12) for accommodating a motor for driving a driven shaft (16) that is outwardly bent relative to the housing (12), the driven shaft being rotatably supported in a gearbox casing (14) and extending out of it with a free end that is provided to accommodate a sanding body. A protective cover (43) encompassing the sanding body is capable of being fastened on the gearbox casing (14) such that its rotation can be adjusted, and the rotational position of which is lockable using a notch lever (30). The device is made safer to operate and more cost effective to manufacture by the fact that the notch lever (30) is positioned transversely to the longitudinal axis of the angle grinder (10) and is pivotable around an axis (34) positioned substantially parallel to the housing (12).

14 Claims, 5 Drawing Sheets

PORTABLE POWER TOOL WITH PROTECTIVE COVER

BACKGROUND OF THE INVENTION

The present invention is based on a portable power tool.

A portable power tool is already known from DE 199 14 855 A1, which is designed as an angle grinder and is provided with a protective cover, the rotational position of which is fixable in the circumferential direction using a simple, releasable locking mechanism. Its catch mechanism is composed essentially of a flat spring, the projections of which are capable of being disengaged from recesses in the protective cover to allow the protective cover to be adjusted by hand, and the retention forces of which are impaired by deformation of the catch mechanism caused by intensive worksite use.

SUMMARY OF THE INVENTION

The present invention has the advantage that a protective cover with an associated robust, simple method for locking the protective cover in place is capable of being installed on conventional portable power tools, on angle grinders in particular, without making any structural changes, the locking method enabling the protective cover to be reliably fixed in any rotational position.

Due to the fact that the notch lever is positioned transversely to the longitudinal axis of the angle grinder and is pivotable around an axis situated substantially parallel to the housing, the tracks of motion of the notch lever are fixed; as a result, changes in the locking characteristics of the protective cover are prevented.

Due to the fact that the notch lever touches the protective cover in a detent position, the protective cover is fixable in this position in a form-locked or non-positive manner.

Due to the fact that the notch lever is elastically preloaded in the direction toward the protective cover, constant contact between the notch lever and the protective cover is ensured.

Due to the fact that the notch lever includes a pusher button on one free end and/or at least one centrally positioned engagement cam on the other end—the engagement cam engaging in the protective cover and holding it in place in a form-locked manner—an easy-to-operate, robust and exact detent means is created.

Due to the fact that the notch lever is pivotably supported on the housing, in particular on the gearbox casing, a flange screw must be loosened and screwed back into place to operate and install the notch lever.

Due to the fact that the pusher button of the notch lever extends transversely to the gearbox casing and past its circumference, it is easily accessible by at least one finger, in particular by the index finger of the operator's hand encompassing the housing in the working position, the protective cover can be adjusted conveniently and quickly, and operating error is prevented.

Due to the fact that the protective cover is capable of being engaged with the rigid engagement cam in a form-locked manner, the protective cover can be positioned in any rotational position largely without play such that it is secured against coming loose unintentionally.

Due to the fact that the gearbox casing has a flange that is capable of being screwed to the housing, whereby one of the flange screws also functions as rotational axis of the notch lever, the locking means of the angle grinder protective cover is easy to install on conventional angle grinders.

Due to the fact that the protective cover has engagement openings arranged in a semicircle for engagement by the engagement cams of the notch lever, the protective cover can be locked securely and in a form-locked manner in predetermined rotational positions relative to the portable power tool.

Due to the fact that the protective cover has a multiple-component design, whereby the first part is an annular collar, in particular having an outwardly-bent edge region, made of a strong material, and a second part is a disk-shaped main body, it is possible to manufacture the protective cover out of different materials in a particularly cost-effective manner, because the parts can be processed more favorably separately from each other, and the protective cover is capable of being manufactured as a lightweight component.

Due to the fact that the annular collar part includes an outwardly-bent region designed in the manner of a hat brim, which includes the engagement openings, the second part, i.e., the main body of the protective cover, can be made of particularly thin material, because the collar part alone absorbs the retention forces between the engagement openings and the engagement cams on the notch lever.

Due to the fact that an annular flat spring is provided in the fastening region of the angle grinder protective cover on the neck of the gearbox casing, the annular flat spring retaining the protective cover on the gearbox casing axially, without play, in a radially rotatable manner, the fastening region of the gearbox casing that supports the protective cover can be composed of relatively roughly tolerated plastic, because the annular flat spring compensates for dimensional deviations and/or wear in the fastening region.

Due to the fact that the gearbox casing includes a fastening region for the protective cover configured as a cylindrical plastic neck, the fastening region belonging to a bearing flange that concentrically encompasses the driven shaft, the weight of the gearbox casing can be reduced and, therefore, so can the weight of the entire portable power tool, so the portable power tool is easier to handle and can be operated without tiring the operator.

BRIEF DESCRIPTION OF THE DRAWINGS

The present invention is described in greater detail below with reference to an exemplary embodiment with associated drawing.

DETAILED DESCRIPTION OF THE PREFERRED EMBODIMENTS

Figure 1:
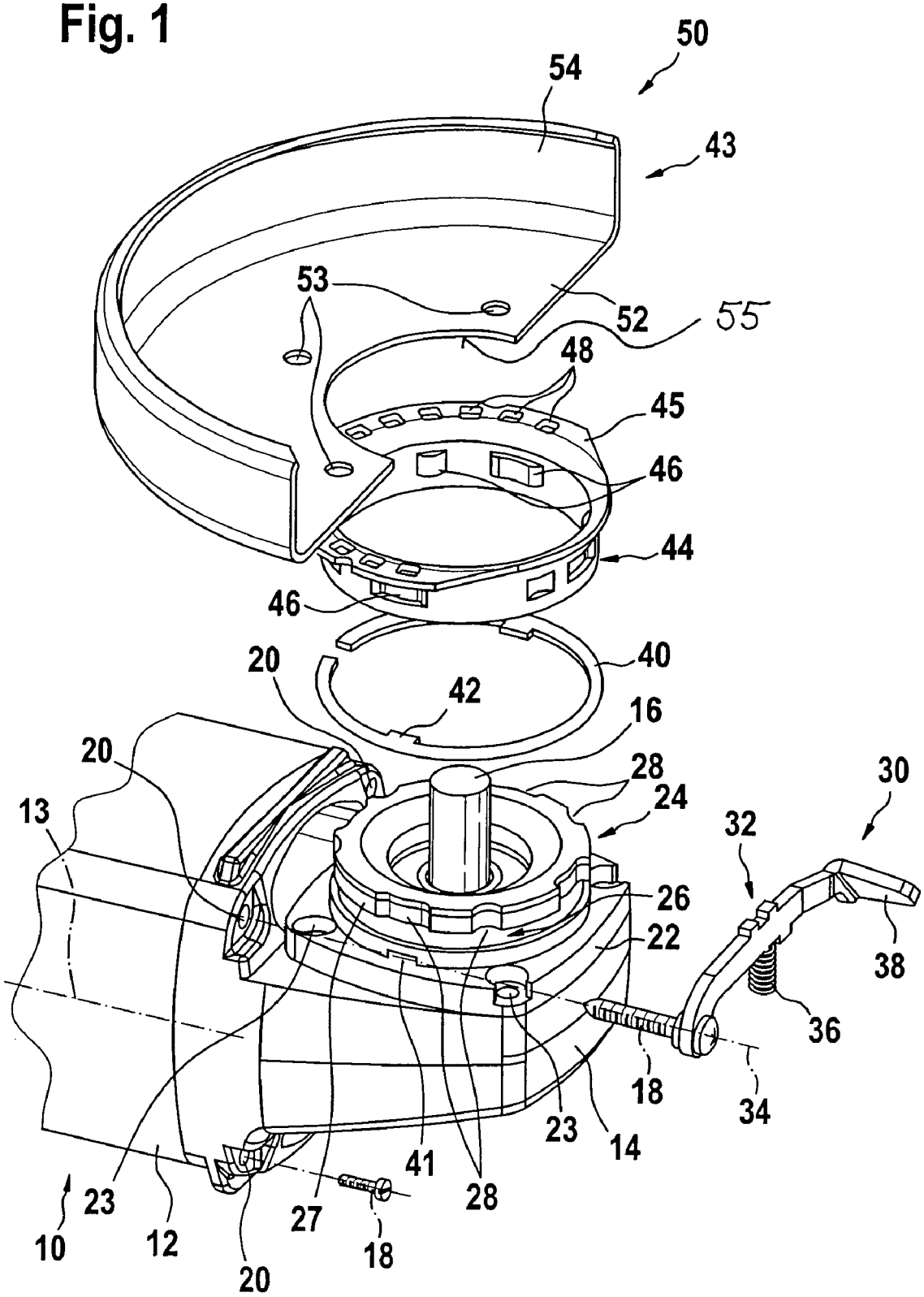
FIG. 1 shows the portable power tool with protective cover in an exploded view.

FIG. 1 shows the front region of a portable power tool 10 designed as an angle grinder, longitudinal housing 12 of which determines a longitudinal axis 13 of portable power tool 10. A gearbox casing 14 is flange-mounted to housing 12, out of which a driven shaft 16 exits at a right angle to longitudinal axis 13. A sanding disk (not shown) is capable of being fastened to its free end, the sanding disk being encompassed by a protective cover 43 to protect the operator of portable power tool 10 from flying chips and/or parts of the sanding disk.

Gearbox casing 14 is fastened to housing 12 with flange screws 18 that engage in flange holes 20 extending parallel with longitudinal axis 13. Gearbox casing 14 includes a bearing flange 22 that encompasses driven shaft 16 in an annular manner. Bearing flange 22 is configured in the shape of a plate in the region facing gearbox casing 14 and is connectable with gearbox casing 14 via a flange screwed connection 23 positioned substantially parallel to driven shaft 16.

Bearing flange 22 includes a cylindrical neck 24 projecting upwardly outward at a right angle to longitudinal axis 13 and accommodating protective cover 43 on its outer circumference and including an annular groove 26 in an axial position nearly in the center, whereby its outer, ridge-like annular groove delineation 27 is interrupted at regular intervals by axial grooves 28 that are assigned to corresponding radial cams 46 in collar 44 of protective cover 43 and which are to be coupled, matching up with each other, using an insertion-rotation motion, in the manner of a key in a lock or a quarter-turn fastener system.

Protective cover 43 is composed of a disk-like, half-moon-shaped main body 53 with a central hole 55, the outer edge 54 of which is outwardly bent and, as a result, extends in the manner of a partial cylindrical Jacket. Main body 50 encompasses, nearly halfway, the circumference of a circular-disk-shaped sanding body (not shown) that is driven in a rotary manner by driven shaft 16, as is commonplace with angular grinders. Main body 50 is connected with a circular-ring-shaped collar 44 that includes a region 45 bent outwardly laterally in the manner of a hat brim. It extends in parallel with perforated disk 52 of main body 50 and concentrically to central hole 55 of perforated disk 52.

Collar 44 is connectable with main body 50 by adhesion, welding, soldering or the like. It Includes impressed, radially inwardly extending radial cams 46. Their dimensions match those of axial grooves 28 in neck 24 of bearing flange 22 such that they pass through them when inserted axially, then enter annular groove 26 when rotated radially, where they hold protective cover 43 tightly in an axially secured manner. In its region that is bent outwardly in the manner of a hat brim, collar 44 includes engagement openings 48 into which engagement cams 32 of a notch lever 30 fit and enter and thereby secure protective cover 43 against twisting on gearbox casing 14.

The particular different widths and identical height of radial cams 46 are matched in terms of dimensions with the corresponding annular grooves 26 having uniform width, and axial grooves 28 having different widths, on neck 24. Only protective covers 43 that fit particular neck 24 grooved in a coded manner can be guided axially via the collar over neck 24 and fastened thereto in an operationally correct manner. To this end, the manufacturer must first slide a snap-ring-like annular spring 40 slotted in a particular manner axially over neck 24, whereby its spring cam 42 must be guided through one of the axial grooves 28 and then, perhaps after being twisted radially, staked in annular groove 26 or fixed in place by bending it upward or downward in a pocket 41 on lower edge of neck 24, thereby securing it against coming loose.

The operator then guides protective cover 43 with radial cams 46 over axial grooves 28 of neck 24 until radial cams 46 contact the lower edge of annular groove 26, and protective cover 43 can then only be twisted, whereby radial cams 46 enter annular groove 26 laterally in the manner of a quarter-turn fastener and are held securely therein and prevented from coming out axially, whereby they are retained in an axially preloaded and, therefore, play-free manner by annular spring 40.

On its side furthest from the housing, notch lever 30 includes, on the top, a region with engagement cams 32 designed to engage in engagement openings 48. Notch lever 30 also includes, on its free end, a hole extending toward engagement cams 32 offset by nearly 90, through which a flange screw 18 is guidable for screwing into a certain flange hole 20, and which functions as pivot axis 34 of the notch lever. Notch lever 30 includes, nearly in the center, a transversely projecting, captively securable compression spring 36 with which notch lever 30 bears against gearbox casing 14 in a preloaded manner such that it can always bear against the outward bend 45 of collar 44 with a minimum force with its cams 32, Thereby securing the engagement cams 32 in engagement openings 48.

Main body 50 of protective cover 43 includes welding holes 53, through which main body 50 can be welded and/or soldered with collar 44 and/or with outward bend 45.

Figure 2:
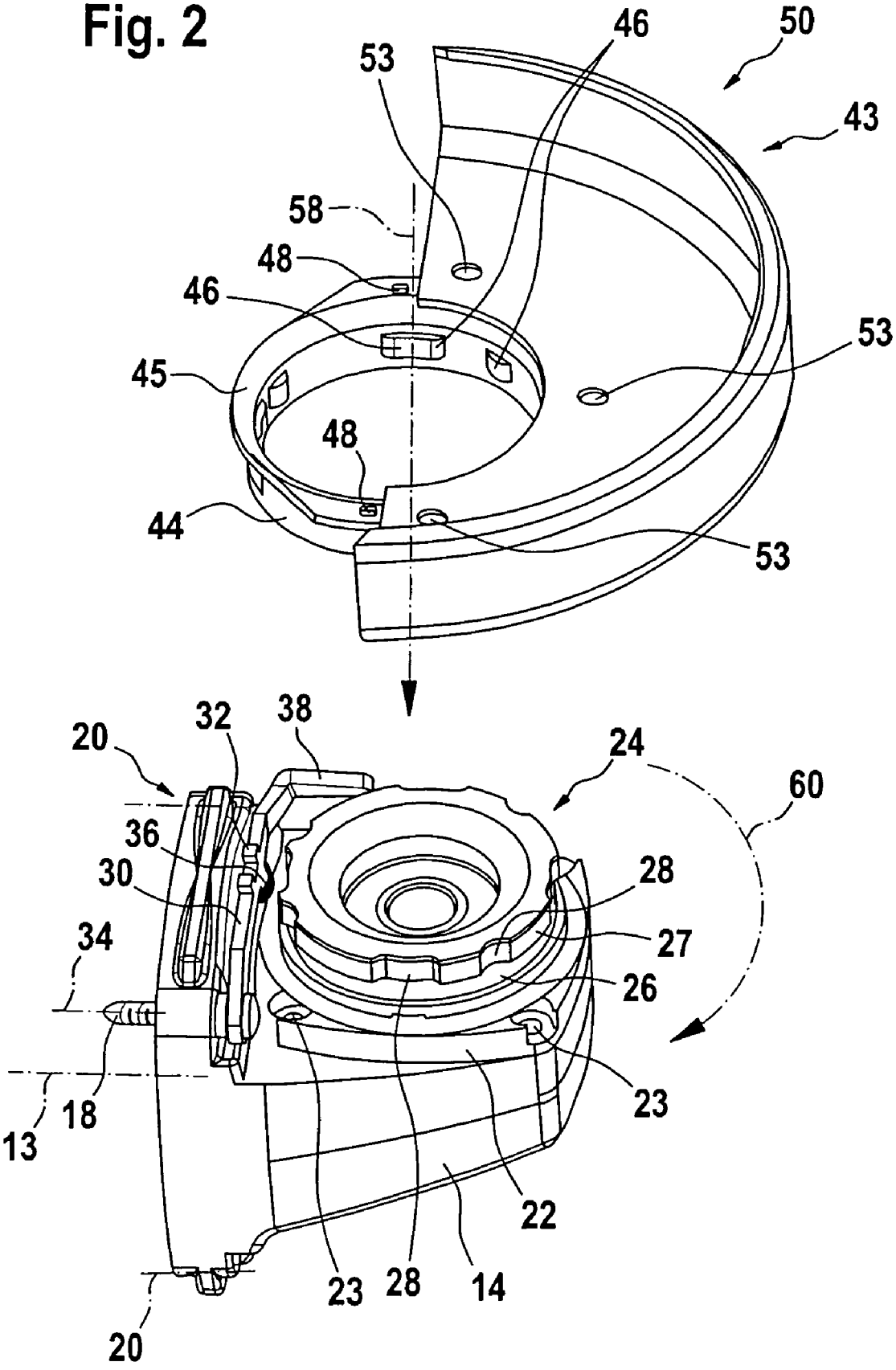
FIG. 2 shows the portable power tool according to FIG. 1 with assembled protective cover before installation.

FIG. 2 shows—as does FIG. 1—the spacial view of portable power tool 10 with protective cover 43, whereby protective cover 43 is assembled and attached to welding holes 53 by welding and forms a unit with collar 44.

Only gearbox casing 14 of portable power tool 10 is shown in FIG. 2, whereby the individual parts shown separately in an exploded view in FIG. 1 are located in the final assembled position, clearly illustrating the arrangement of notch lever 30. Going beyond FIG. 1, FIG. 2 shows an axial arrow 58, according to which protective cover 43 is slid over neck 24 and then twisted in accordance with a curved arrow 60 such that the round edge of main body 50 is turned relative to the position shown. As a result, operating personnel situated behind the tool engagement site in the extension of longitudinal axis 13 are protected against dust, chips, splinters or the like.

To turn protective cover 43 out of its selected detent position, an end region of notch lever 30 configured as a pusher button 38 must be swiveled away from protective cover 43 and toward gearbox casing 14, so that the two engagement cams 32 come out of the two diametrically opposed engagement openings 48 and no longer prevent protective cover 43 from turning. Notch lever 30 is released only when in the desired rotational position, so it can engage with its engagement cams 32 in engagement openings 48—preloaded by compression spring 36—and secure protective cover 43 against unintentional motion.

Figure 3:
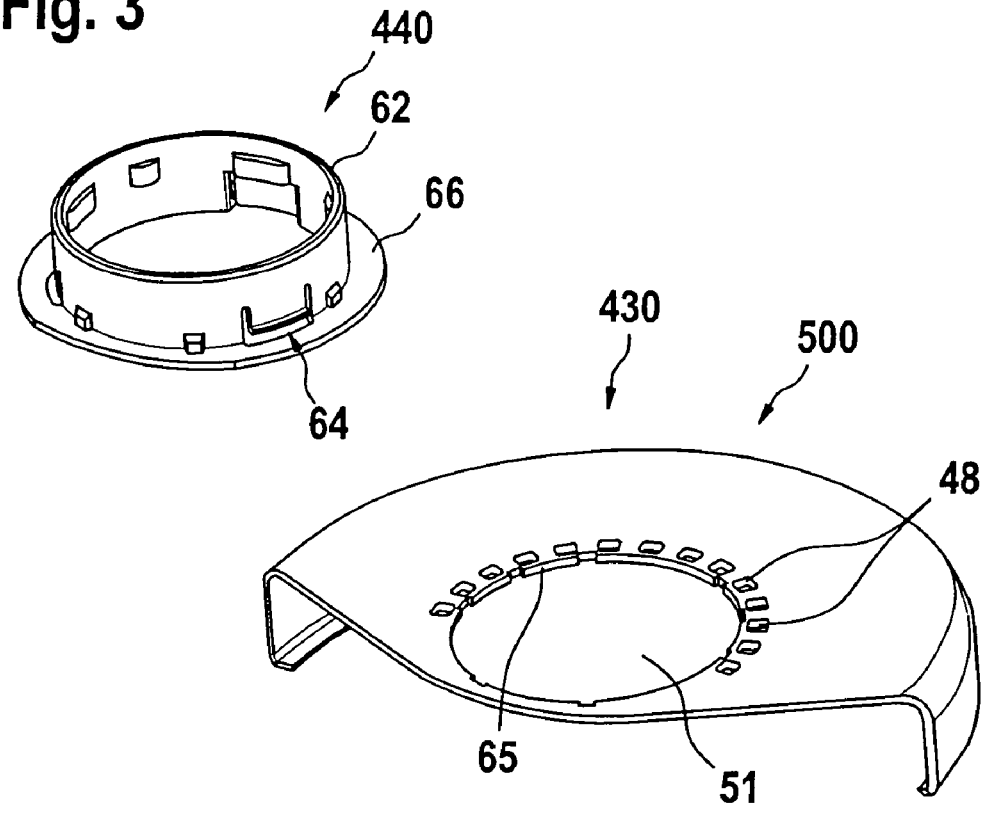
FIG. 3 shows the individual parts of a dual-component exemplary embodiment of the protective cover.

FIG. 3 shows a further exemplary embodiment of a protective cover 430 that differs from protective cover 43 in FIGS. 1 and 2 in that collar 440 is composed of plastic or metal that can engage via a radially outwardly extending snap-in hook 64 in corresponding snap-in openings 65 of main body 500 by inserting it through central hole 51 and fixing it in place via overlatching, so that its, hat-brim-like region 66 comes to rest on main body 500.

In this case, engagement openings 48 are located in main body 500, which must be designed thicker in this case to be able to absorb the engagement forces and/or retention forces for securing protective cover 24 on gearbox casing 14 by notch lever 30.

Figure 4:
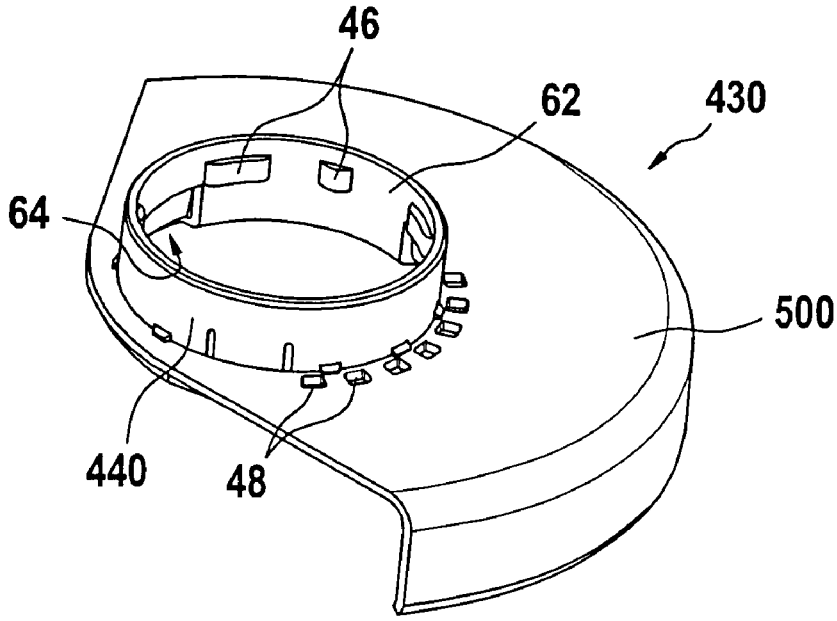
FIG. 4 shows the protective cover according to FIG. 3, assembled.
Figure 5:
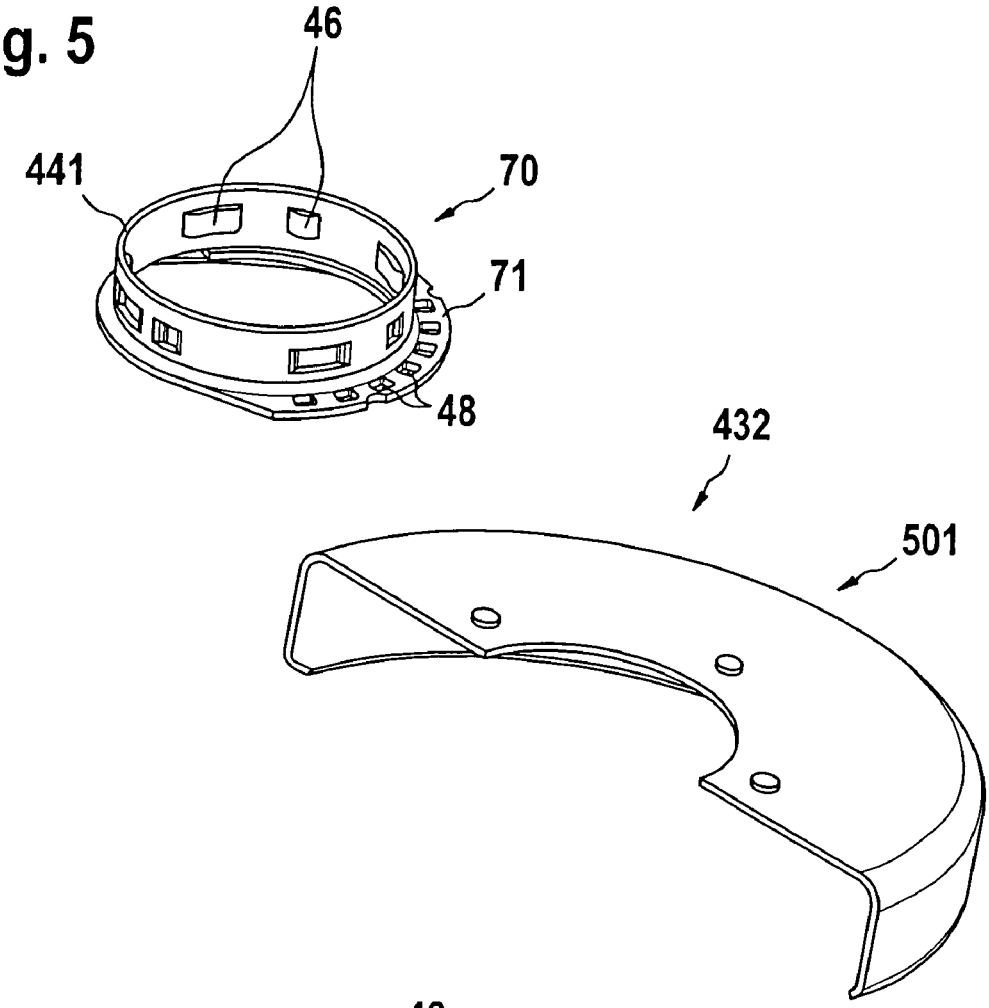
FIG. 5 shows a second exemplary embodiment of a dual-component protective cover, in an exploded view.

FIG. 4 shows protective cover 430 in the installed state, whereby it is clear that snap-in hooks 64 project radially outwardly and grip over main body 500 and secure its position relative to collar 440. FIG. 5 shows a further exemplary embodiment of a removed protective cover 432, collar 441 of which is welded with main body 501, thereby corresponding substantially to protective cover 43 according to FIG. 2.

Figure 6:
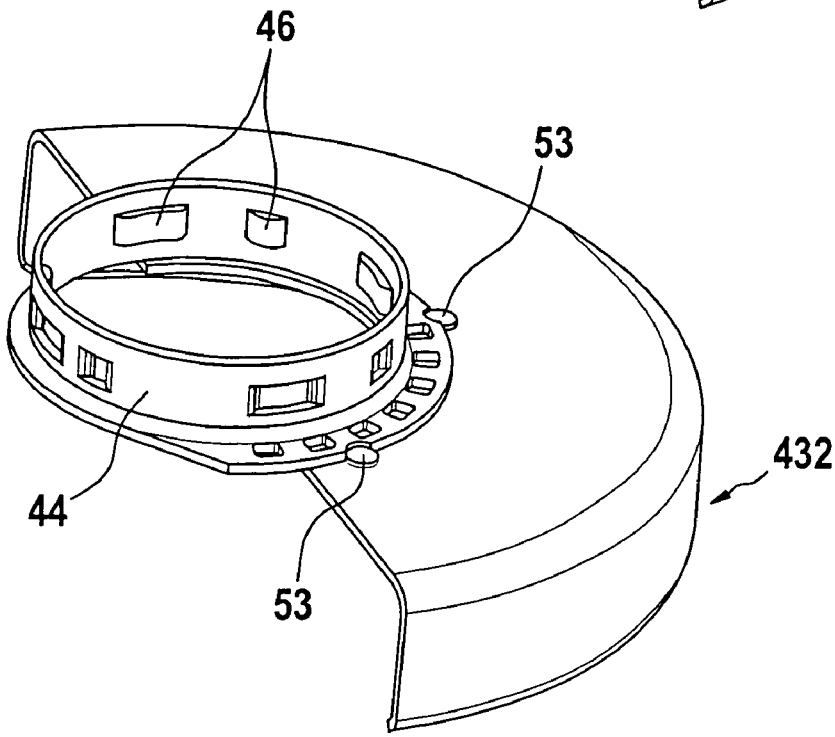
FIG. 6 shows the exemplary embodiment according to FIG. 5, assembled.

FIG. 6 shows protective cover 432, whereby, unlike the previous figures, it shows that welding holes 53 are welded with collar 44.

Figure 7:
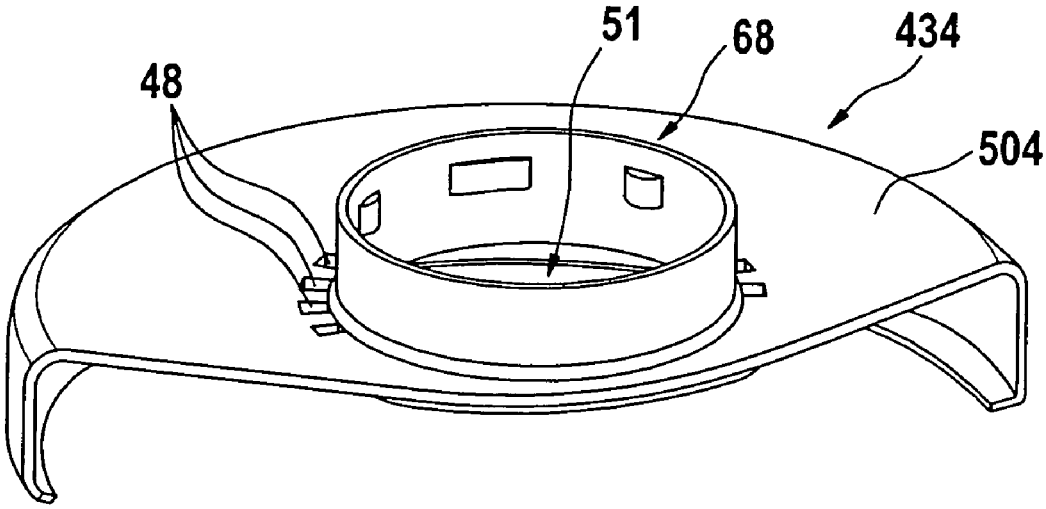
FIG. 7 shows a dual-component protective cover with plastic collar and metallic main body.

FIG. 7 shows a protective cover 434, the collar ring 48 of which is composed of plastic which is applied by injection molding to main body 504 in the region of its central hole 51.

Figure 8:
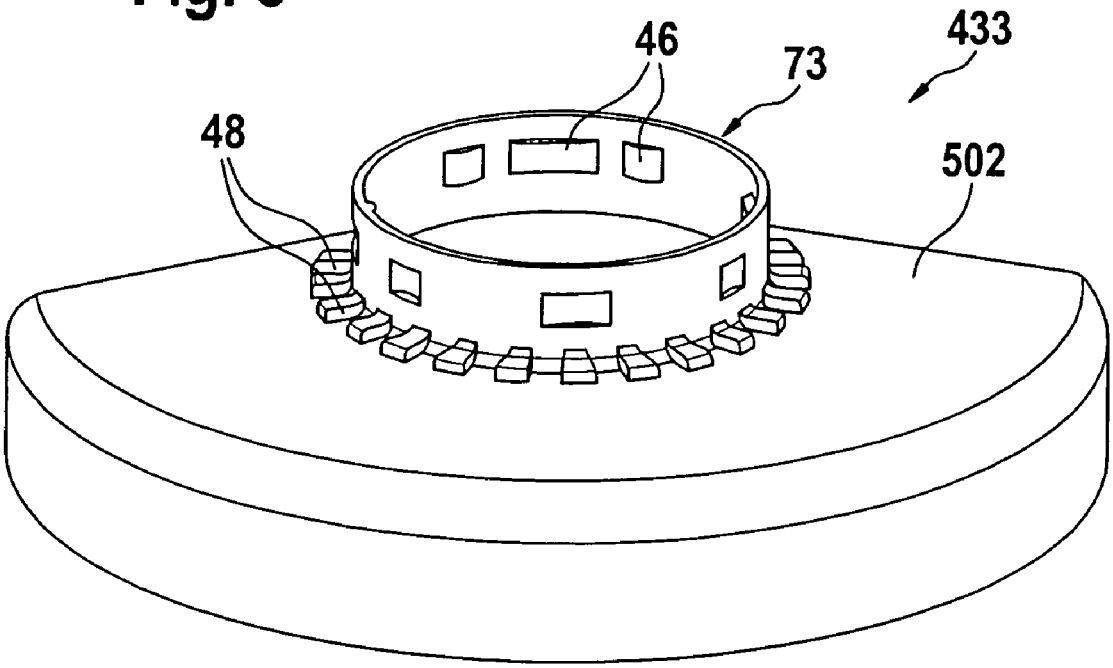
FIG. 8 shows a single-component protective cover according to the present invention, composed of metal.

FIG. 8 shows a single-component protective cover 433 made of steel, in the case of which, as also shown in FIG. 7, engagement openings 48 are located in main body 502 (504), whereby the advantage of this protective cover is that it is capable of being manufactured in a single working step, even though more material is required in this case than with the other versions.

What is claimed is:

1. A portable power tool, with a longitudinal housing (12) for accommodating a motor for driving a driven shaft (16) that is angled relative to the housing (12), the driven shaft being rotatably supported in a gearbox casing (14) and extending out of the gearbox casing (14) with a free end that is provided to accommodate a sanding body, whereby a protective cover (43) encompassing the sanding body is capable of being fastened on the gearbox casing (14) such that its rotation can be adjusted, and the rotational position of which is lockable using a notch ever (30), wherein the notch lever (30) is positioned transversely to the longitudinal axis of the angle grinder (10) and is pivotable around a pivot axis (34) situated substantially parallel to a longitudinal axis of the housing (12), wherein a pivot axis is a geometrically defined axis, and wherein the notch lever (30) includes at least one rigid engagement cam, wherein said at least one cam secures the protective cover (43) in place in a form-locking manner without play.

2. The portable power tool as recited in claim 1 wherein the notch lever (30) touches the protective cover (43) in a detent position.

3. The portable power tool as recited in claim 1, wherein the notch lever (30) is elastically preloaded in the direction toward the protective cover (43).

4. The portable power tool as recited in claim 1, wherein the notch lever (30) Includes centrally located engagement cams (32) that are oriented toward the protective cover, and a pusher button (38) on a free end for releasing said engagement cams.

5. The portable power tool as recited in claim 1, wherein the notch lever (30) is fastened on the housing (12, 14).

6. The portable power tool of claim 5, wherein the notch lever (30) is fastened on the gearbox casing (14).

7. The portable power tool as recited in claim 4, wherein the pusher button (38) of the notch lever (30) projects transversely to the gearbox casing (14) and a circumference of the gearbox casing, so that the pusher button is accessible by at least one finger of an operator's hand encompassing the housing (12).

8. The portable power tool as recited in claim 1, wherein the gearbox casing (14) includes a gear flange (17) that is capable of being screwed to the housing (12), whereby one of the flange screws (18) also functions as pivot axis (34) of the notch lever (30).

9. The portable power tool as recited in claim 1, wherein the protective cover (43) is capable of being coupled with the engagement cams (32) of the notch lever in a form-locked manner.

10. The portable power tool as recited in claim 1, wherein the protective cover (32) has engagement openings (48) arranged in a semicircle, into which the engagement cams (32) of the notch lever (30) are capable of engaging.

11. The portable power tool of claim 1 wherein the power tool is an angle grinder.

12. A portable power tool in the form of an angle grinder, with a longitudinal housing (12) for accommodating a motor for driving a driven shaft (16) that is angled relative to the housing (12), the driven shaft being rotatably supported in a gearbox casing (14) and extending out of the gearbox casing (14) with a free end that is provided to accommodate a sanding body, whereby a protective cover (43) encompassing the sanding body is capable of being fastened on the gearbox casing (14) such that its rotation can be adjusted, and the rotational position of which is lockable using a notch lever (30), wherein the notch lever (30) is positioned transversely to the longitudinal axis of the Angle grinder (10) and is pivotable around a pivot axis (34) situated substantially parallel to a longitudinal axis of the housing (12), wherein the notch lever (30) includes centrally located engagement cams (32) that are oriented toward the protective cover, and a pusher (35) on a free end for releasing the engagement cams.

13. A portable power tool in the form of an angle grinder, with a longitudinal housing (12) for accommodating a motor for driving a driven shaft (16) that is angled relative to the housing (12), the driven shaft being rotatably supported in a gearbox casing (14) and extending out of the gearbox with a free end that is provided to accommodate a sanding body, whereby a protective cover (43) encompassing the sanding body is capable of being fastened on the gearbox casing (14) such that its rotation can be adjusted, and the rotational position of which is lockable using a notch lever (30), wherein the notch lever (30) is positioned transversely to the longitudinal axis of the angle grinder (10) and Is pivotable around a pivot axis (34) situated substantially parallel to a longitudinal axis of the housing (12), wherein the gearbox casing (14) includes a gear flange (17) that is capable of being screwed to the housing (12), whereby one of the flange screws (18) also functions as pivot axis (34) of the notch lever (30).

14. A portable power tool, in particular an angle grinder (10), with a longitudinal housing (12) for accommodating a motor for driving a driven shaft (16) that is angled relative to the housing (12), the driven shaft being rotatably supported in a gearbox casing (14) and extending out of the gearbox with a free end that is provided to accommodate a sanding body, whereby a protective cover (43) encompassing the sanding body is capable of being fastened on the gearbox casing (14) such that its rotation can be adjusted, and the rotational position of which is lockable using a notch lever (30), wherein the notch lever (30) is positioned transversely to the longitudinal axis of the angle grinder (10) and is pivotable around an axis (34) situated substantially parallel to a longitudinal axis of the housing (12), wherein the pivot axis is a geometrically precise axis, wherein the notch lever (30) includes a rigid engagement cam, wherein said cam secures the protective cover (43) in place in a form-locking manner without play, wherein the notch lever (30) is positioned such that a first end of the notch lever (30) is pivotable about the axis (34), and wherein a second end of the notch lever (30) is accessible as a handgrip or pusher button by an operator of the power tool.

* * * * *